US011952233B2

(12) United States Patent
Okada et al.

(10) Patent No.: US 11,952,233 B2
(45) Date of Patent: Apr. 9, 2024

(54) PERFORATION DEVICE AND SHEET POST-PROCESSING DEVICE PROVIDED THEREWITH

(71) Applicant: KYOCERA Document Solutions Inc., Osaka (JP)

(72) Inventors: Rina Okada, Osaka (JP); Masahiko Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 281 days.

(21) Appl. No.: 17/553,444

(22) Filed: Dec. 16, 2021

(65) Prior Publication Data

US 2022/0204304 A1 Jun. 30, 2022

(30) Foreign Application Priority Data

Dec. 24, 2020 (JP) ..... 2020-214972

(51) Int. Cl.
*B65H 35/00* (2006.01)

(52) U.S. Cl.
CPC ... *B65H 35/0006* (2013.01); *B65H 2403/943* (2013.01)

(58) Field of Classification Search
CPC ..... B65H 2403/512; B65H 35/0006; B65H 2301/5152; B65H 2403/514
See application file for complete search history.

(56) References Cited

U.S. PATENT DOCUMENTS

2018/0236682 A1* 8/2018 Aono ..... H02P 3/12
2023/0137030 A1* 5/2023 Okada ..... B26D 7/18 83/679
2023/0312298 A1* 10/2023 Okada ..... B26F 1/10 83/549

FOREIGN PATENT DOCUMENTS

JP H 09-136762 A 5/1997
JP 2018-75656 A 5/2018
JP 2018-100171 A 6/2018

OTHER PUBLICATIONS

Chinese Office Action dated Jul. 20, 2023, issued to a corresponding Chinese Application No. 202111590527.0.

* cited by examiner

*Primary Examiner* — Howard J Sanders
(74) *Attorney, Agent, or Firm* — Stein IP LLC

(57) ABSTRACT

A perforation device includes a shaft, a perforation motor, at least a first perforation portion, at least a second perforation portion, at least a first cam for reciprocating a first perforation blade in the first perforation portion, at least a second cam for reciprocating a second perforation blade in the second perforation portion, a rotation speed detecting portion, a home position detecting portion, and a controller. In second perforation processing in which the shaft is rotated one turn to perform first perforation with the first perforation portion and second perforation with the second perforation portion in sequence, the controller senses, with the rotation speed detecting portion, the rotation speed of the shaft after the first perforation blade penetrates the sheet in the first perforation and, based on the rotation speed detecting, the controller determines the timing of starting braking control in the second perforation and performs braking control.

8 Claims, 9 Drawing Sheets

PERFORATION DEVICE AND SHEET POST-PROCESSING DEVICE PROVIDED THEREWITH

INCORPORATION BY REFERENCE

This application is based on and claims the benefit of priority from Japanese Patent Application No. 2020-214972 filed on Dec. 24, 2020, the contents of which are hereby incorporated by reference.

BACKGROUND

The present disclosure relates to a perforation device for perforating sheets, and to a sheet post-processing device incorporating a perforation device.

Sheet post-processing devices (finishers) are widely used that are mounted in image forming apparatuses to perform predetermined post-processing on sheets having undergone image formation. Some sheet post-processing devices incorporate a perforation device for perforating (forming punch holes in) sheets.

SUMMARY

According to one aspect of the present disclosure, a perforation device includes a shaft, a perforation motor, an eccentric cam, a perforation portion, a rotation speed detecting portion, a home position detecting portion, and a controller. The perforation motor rotates the shaft. The eccentric cam is fitted to the shaft. The perforation portion has a perforation blade that perforates a sheet, and reciprocates the perforation blade in directions toward and away from the sheet as the eccentric cam rotates. The rotation speed detecting portion detects the rotation speed of the shaft. The home position detecting portion senses whether the perforation blade is at a home position away from the sheet. The controller controls the driving of the perforation motor. The perforation portion includes at least one first perforation portion that performs first perforation on the sheet with a first perforation blade and at least one second perforation portion that performs second perforation on the sheet with a second perforation blade. The first and second perforation portion are disposed at positions away from each other in an axial direction with respect to the shaft. The eccentric cam includes at least a first cam that reciprocates the first perforation blade in the first perforation portion and at least a second cam that reciprocates the second perforation blade in the second perforation portion. The first and second cams are disposed at positions facing the first perforation portion and the second perforation portions respectively, and the second cam is disposed with a delay in phase of 180° from the first cam with respect to a first rotation direction of the shaft. The controller performs a first perforation processing to perform the first perforation with the first perforation portion by rotating the shaft through 180°, a second perforation processing to perform the first perforation with the first perforation portion and the second perforation with the second perforation portion in sequence, and braking control to brake the perforation motor such that the first and second perforation blades stop at the home position. The controller detects with the rotation speed detecting portion, the rotation speed of the shaft after the first perforation blade penetrates the sheet during the first perforation, and based on the rotation speed detected by the rotation speed detecting portion, the controller determines the timing of starting the braking control in the second perforation and performs the braking control.

DETAILED DESCRIPTION

With reference to FIGS. 1 to 12, a description will be given of a perforation device 1 according to the present disclosure, a sheet post-processing device 2 that incorporates the perforation device 1, and an image forming apparatus 100 in which the sheet post-processing device 2 is mounted. Any features in terms of structure, arrangement, and the like that are specifically mentioned in the course of description of the embodiment are merely illustrative and are in no way meant to limit the scope of what is disclosed herein.

Figure 1:
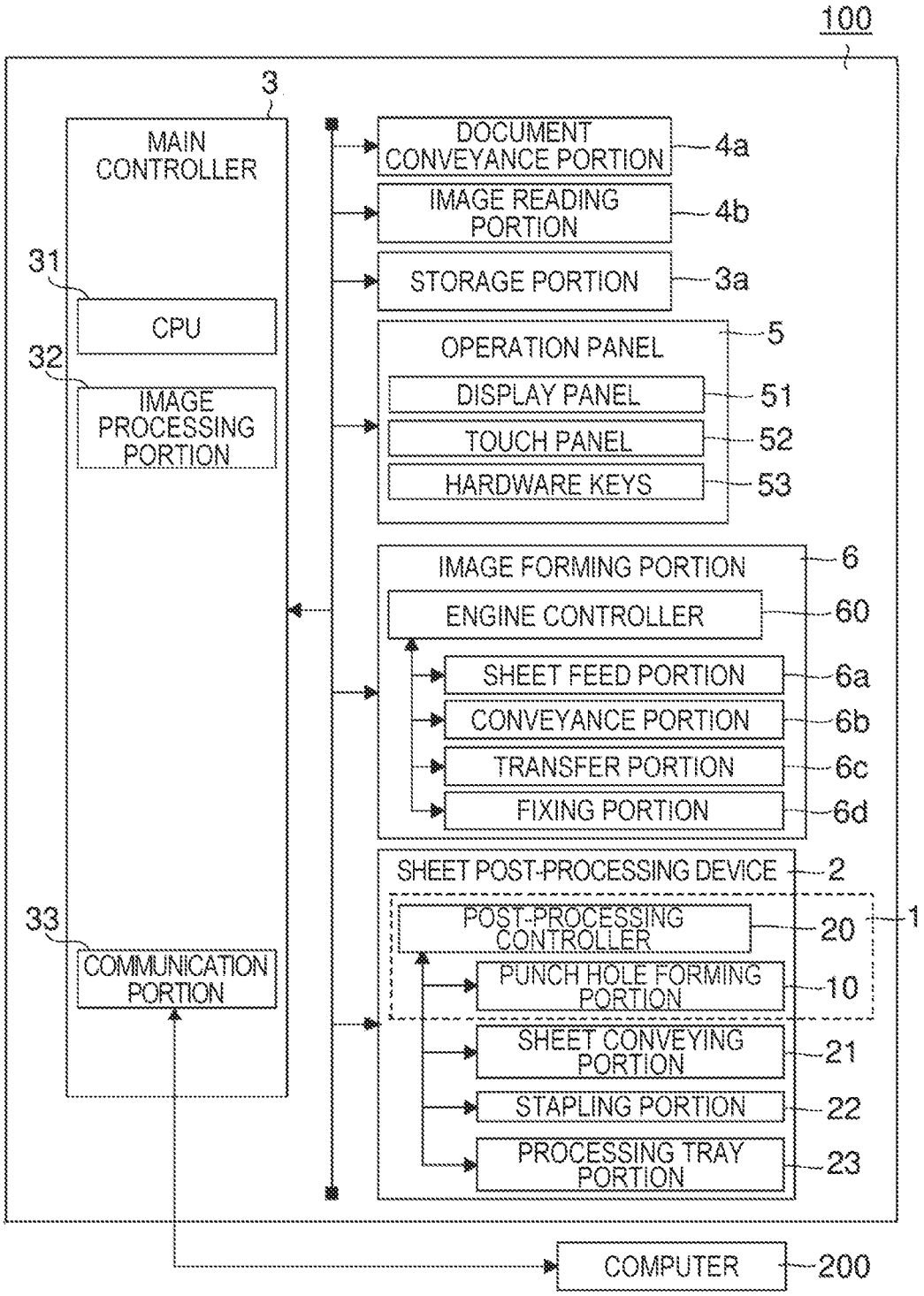
FIG. 1 is a block diagram showing one example of control paths in a sheet post-processing device incorporating a perforation device according to the present disclosure and an image forming apparatus mounted with the sheet post-processing device.

Outline of an Image Forming Apparatus: FIG. 1 is a block diagram showing one example of the control paths in the sheet post-processing device 2 incorporating the perforation device 1 according to the present disclosure, and in the image forming apparatus 100 mounted with the sheet post-processing device 2. First, with reference to FIG. 1, the control paths in the image forming apparatus 100 (here a multifunction peripheral) will be described.

The image forming apparatus 100 includes a main controller 3 and a storage portion 3*a*. The main controller 3 centrally controls the operation of the entire image forming apparatus 100 to control the individual blocks in the image forming apparatus 100. The main controller 3 includes a CPU 31, an image processing portion 32, and a communication portion 33. The CPU 31 performs control-related calculation as well as control. The image processing portion 32 performs, on image data transmitted to it, processing required in a job (printing). The storage portion 3*a* includes storage devices such as a ROM, a RAM, and a HDD. The storage portion 3*a* stores control programs, image data, and the like. The communication portion 33 is an interface for communication with a computer 200 such as a PC or a server. The communication portion 33 receives data (print data), such as image data, that represents what is to be printed.

The main controller 3 is connected to a document conveyance portion 4*a* and an image reading portion 4*b* so as to allow mutual communication. The document conveyance portion 4*a* conveys a placed document toward the reading position. The image reading portion 4*b* can read a document that is conveyed by the document conveyance portion 4*a* and a document placed on a document stage (contact glass, not illustrated). The image reading portion 4*b* generates image data. The main controller 3 controls the operation of the document conveyance portion 4*a* and the image reading portion 4*b*. The main controller 3 is connected to an operation panel 5 so as to allow mutual communication. The operation panel 5 includes a display panel 51, a touch panel 52, and hardware keys 53. The operation panel 5 accepts operation by a user.

The image forming apparatus 100 includes an image forming portion 6. The image forming portion 6 includes an engine controller 60, a sheet feed portion 6*a*, a conveyance portion 6*b*, a transfer portion 6*c*, and a fixing portion 6*d*. The engine controller 60 is connected to the main controller 3 so as to allow mutual communication. The main controller 3 transmits to the engine controller 60 a print instruction, what is to be done in a print job, and the image data to be used in printing. According to the instruction from the main controller 3, the engine controller 60 controls the operation of the sheet feed portion 6*a*, the conveyance portion 6*b*, the transfer portion 6*c*, and the fixing portion 6*d*, Specifically, the engine controller 60 sequentially performs sheet feeding operation to make the sheet feed portion 6*a* feed one sheet after another, conveying operation to make the conveyance portion 6*b* convey the sheet fed to it, image forming operation to form a toner image, transfer operation to transfer the toner image to a sheet in the transfer portion 6*c*, and fixing operation to make the fixing portion 6*d* fix the toner image transferred to the sheet.

Figure 2:
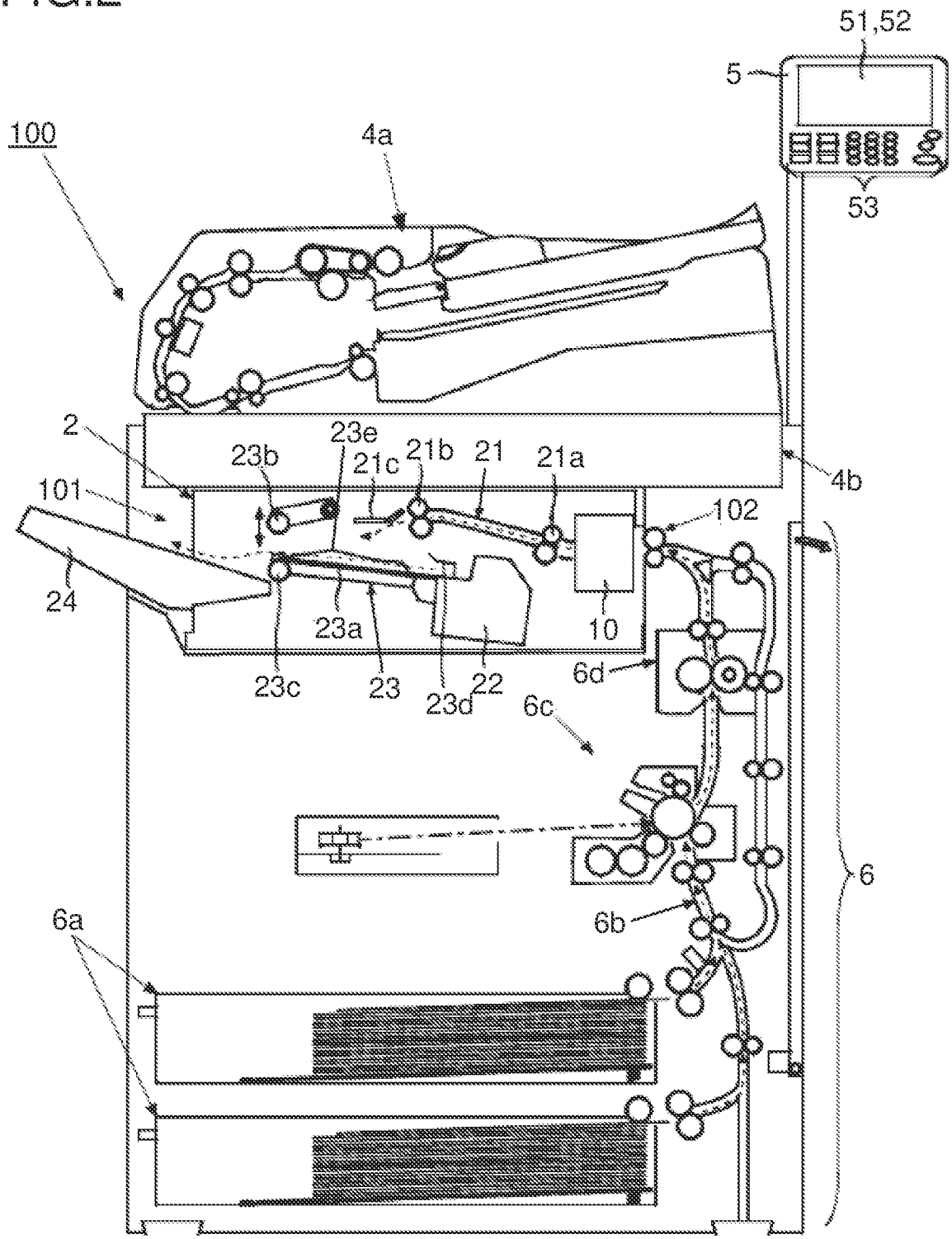
FIG. 2 is an outline sectional view showing one example of the image forming apparatus mounted with the sheet post-processing device.

Sheet Post-Processing Device 2: Next, with reference to FIGS. 1 and 2, the sheet post-processing device 2 according to the embodiment will be described in outline. FIG. 2 is an outline sectional view showing one example of the image forming apparatus 100 mounted with the sheet post-processing device 2 according to the embodiment.

The sheet post-processing device 2 performs various kinds of post-processing on a sheet that has undergone image formation and are discharged from the image forming apparatus 100. The sheet post-processing device 2 is mounted in the body of the image forming apparatus 100. As shown in FIG. 2, the sheet post-processing device 2 is mounted in (fitted into) an in-body discharge portion 101 in the image firming apparatus 100. A sheet post-processing device 2 of a type that is mounted on a side face of the image forming apparatus 100 is also known.

A sheet that has an image formed on it and has passed through the fixing portion 6*d* is introduced through an introduction port 102 into the sheet post-processing device 2. The sheet post-processing device 2 includes a punch hole forming portion 10, a sheet conveying portion 21, a stapling portion 22, a processing tray portion 23, and a discharge tray 24. As shown in FIG. 1, the sheet post-processing device 2 also includes a post-processing controller 20 (corresponding to a controller). The post-processing controller 20 is a circuit hoard that includes a processing circuit 2*a* such as a CPU, a memory 2*b*, and a timer circuit 2*c*. The post-processing controller 20 controls the operation of different blocks in the sheet post-processing device 2. The post-processing controller 20 does not necessarily have to be included in the sheet post-processing device 2; instead of the post-processing controller 20, the main controller 3 or the engine controller 60 in the image forming apparatus 100 can control the operation of the sheet post-processing deice 2.

The sheet post-processing device 2 includes the perforation device 1. As shown in FIG. 1, the perforation device 1 includes the post-processing controller 20 and the punch hole forming portion 10. If a setting is made on the operation panel 5 to perform perforation, the post-processing controller 20 makes the punch hole forming portion 10 perforate sheets.

The sheet conveying portion 21 conveys the sheet that has passed through the punch hole forming portion 10 to the processing tray portion 23. The sheet conveying portion 21 includes a pair of first conveyance rollers 21*a*, a pair of second conveyance rollers 21*b*, and a sheet conveyance guide 21*c*. The processing tray portion 23 includes a processing tray 23*a*, a first discharge roller 23*b*, a second discharge roller 23*c*, a stopper 23*d*, and a width restricting plate 23*e*. The post-processing controller 20 and discharges the bundle of sheets conveyed to and stacked in the processing tray portion 23. If a setting is made on the operation panel 5 to perform stapling, the post-processing controller 20 makes the stapling portion 22 staple the bundle of sheets stacked in the processing tray portion 23 before it is discharged.

Figure 3:
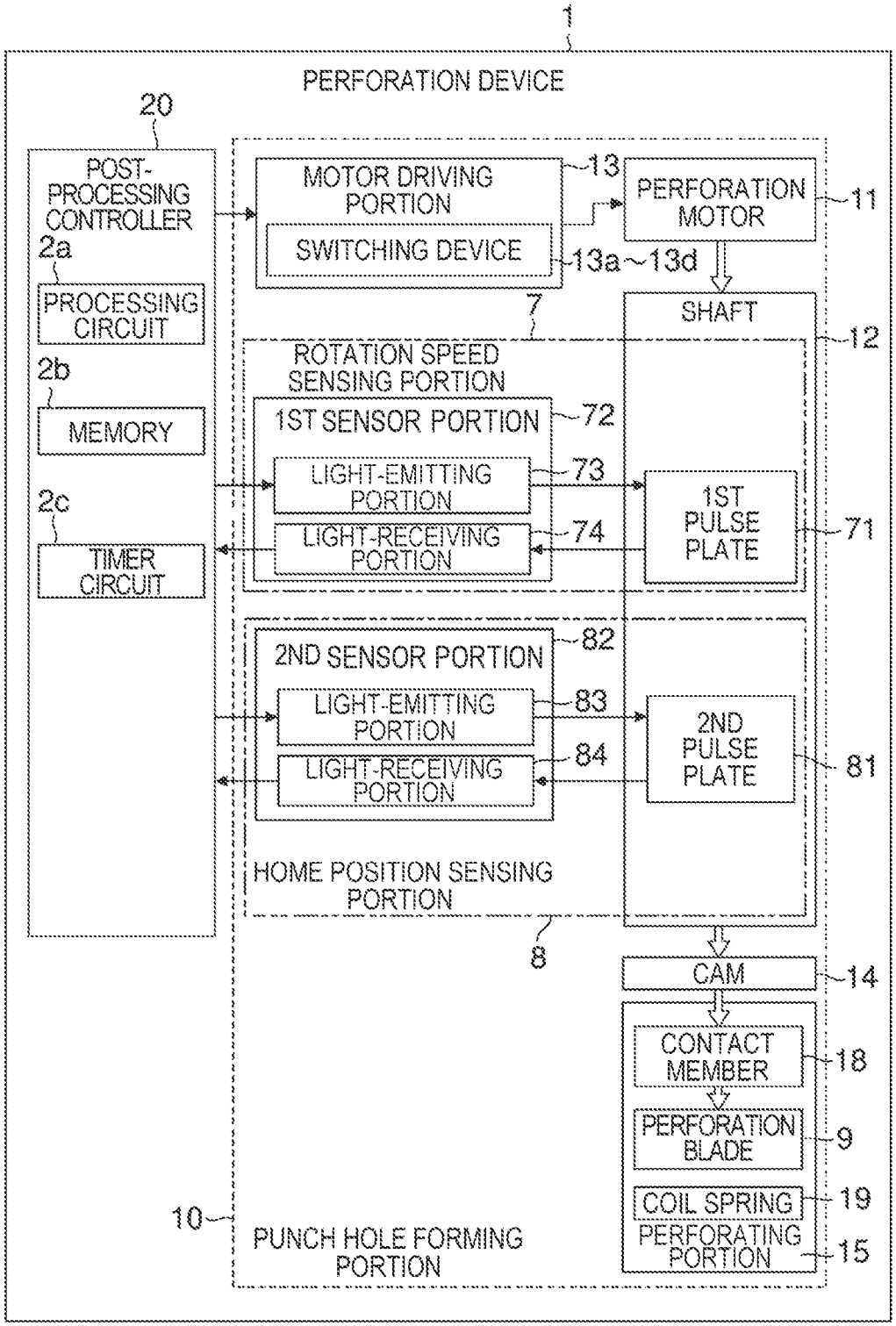
FIG. 3 is a block diagram showing one example of control paths in the perforation device according to one embodiment of the present disclosure.
Figure 4:
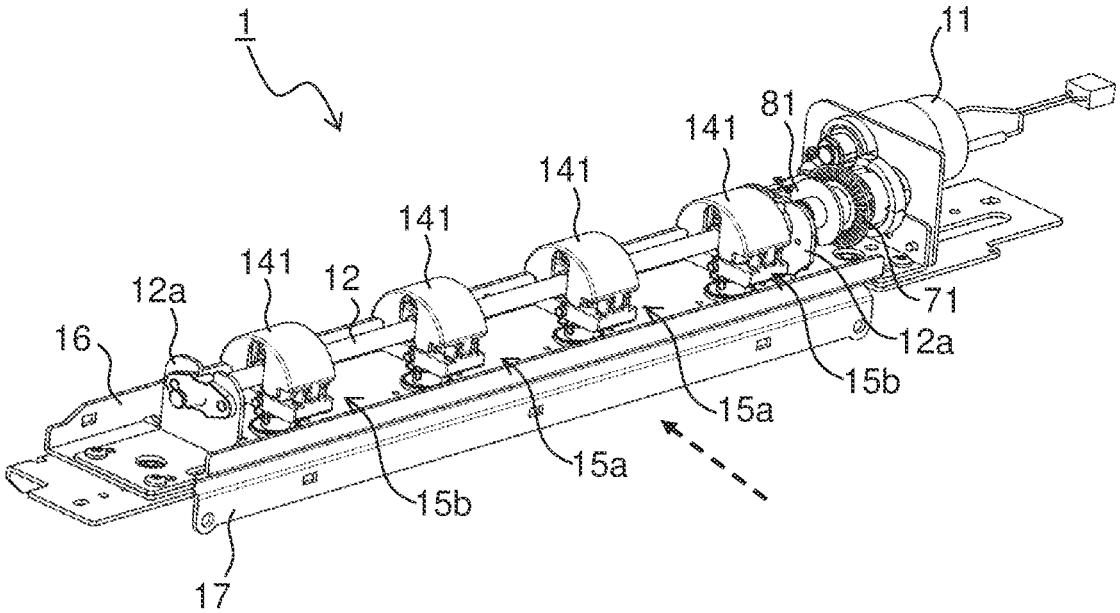
FIG. 4 is a perspective view of the perforation device according to the embodiment, as seen from upstream in the sheet conveyance direction.
Figure 5:
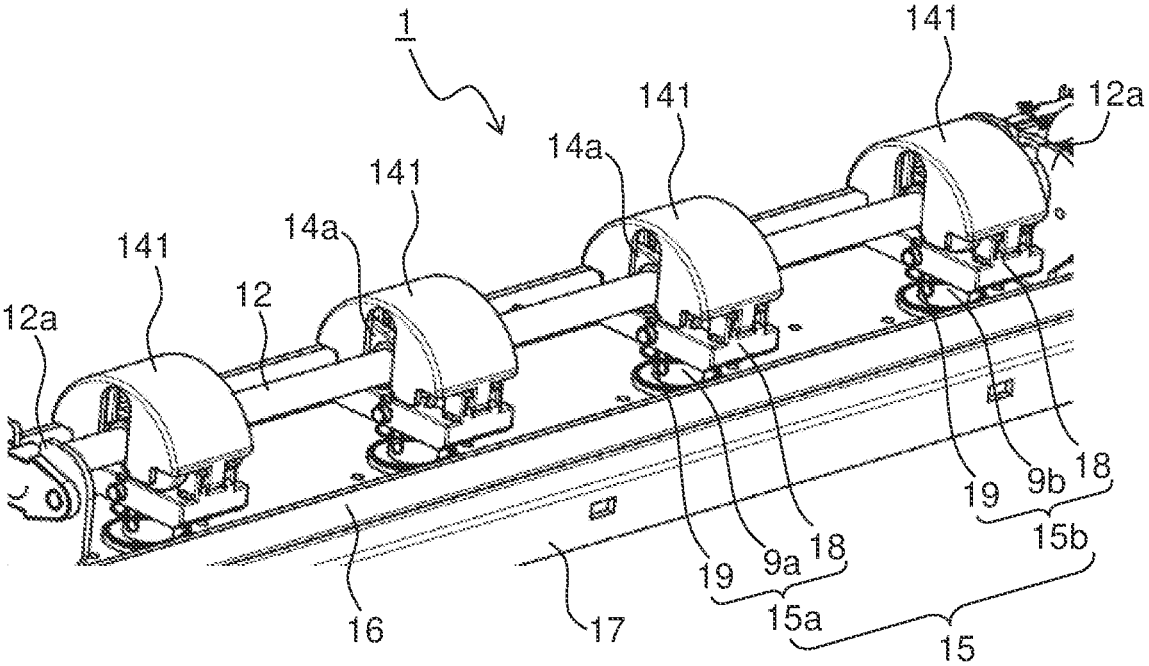
FIG. 5 is an enlarged view of first and second perforation portions in FIG. 4.
Figure 6:
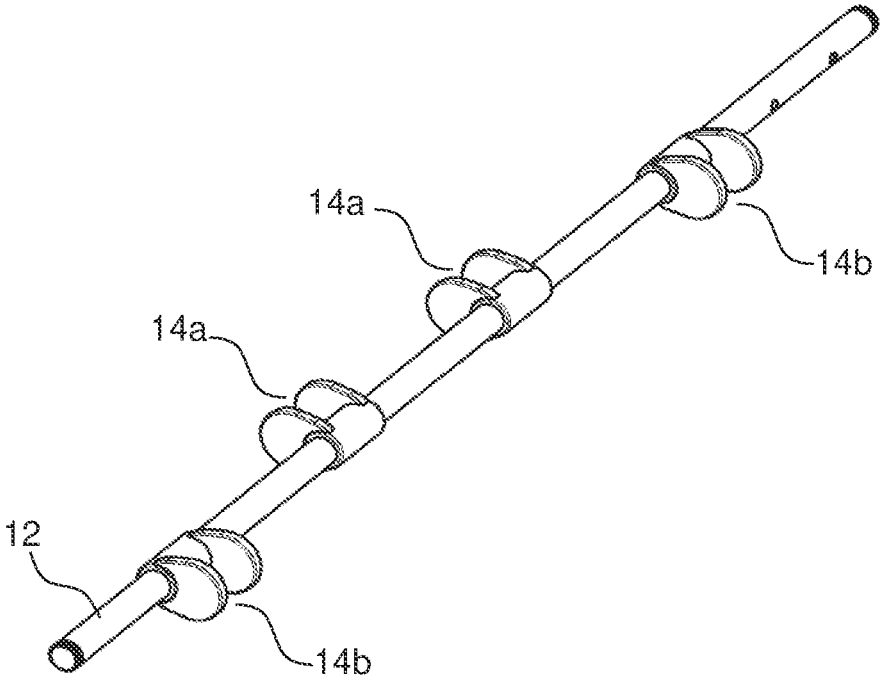
FIG. 6 is a perspective view of a shaft and cams used in the perforation device according to the embodiment.

Perforation Device 1: Next, with reference to FIGS. 3 to 9, the perforation device 1 according to the embodiment will be described. FIG. 3 is a block diagram showing one example of the control paths in the perforation device 1 according to one embodiment of the present disclosure. FIGS. 4 and 5 are perspective views of one example of the perforation device 1 according to the embodiment. FIG. 6 is a perspective view of a shaft 12 and cams 14 used in the perforation device 1 according to the embodiment. FIGS. 4 and 5 are perspective views of the perforation device 1 as seen from upstream in the sheet conveyance direction, a broken-line arrow in FIG. 4 indicating the direction in which a sheet is introduced into it. FIG. 4 shows the perforation device 1 with covers 141 fitted on it, and FIG. 5 is an enlarged view around perforation portions 15 in FIG. 4.

As shown in FIG. 3, the perforation device 1 includes the post-processing controller 20 and the punch hole forming portion 10. The punch hole forming portion 10 includes a perforation motor 11, a shaft 12, a motor driving portion 13, a cam 14 (eccentric cam), a perforation portion 15, a rotation speed detecting portion 7, and a home position detecting portion 8. The perforation portion 15 includes a perforation blade 9. Hollow arrows in FIG. 3 indicate the transmission path for the driving force from the perforation motor 11.

The perforation motor 11 reciprocates the perforation blade 9. Used as the perforation motor 11 is, for example, a DC blush motor. The motor driving portion 13 includes a plurality of (here four) switching devices 13*a* to 13*d*. The switching devices 13*a* to 13*d* turn on and off the supply of electric current to the perforation motor 11. The post-processing controller 20 controls the switching devices 13*a* to 13*d*. The post-processing controller 20 controls the motor driving portion 13 to control the braking of the perforation motor 11. The braking control will be described in detail later.

As shown in FIGS. 4 and 5, the perforation device 1 includes an upper guide 16 and a lower guide 17 that are disposed opposite each other across a predetermined interval. Over the upper guide 16, a plurality of perforation portions 15 are provided, with four perforation portions 15 provided in the illustrated example (to be compatible with a four-hole system). Specifically, the perforation portions 15 include first perforation portions 15*a* that form two holes in a middle part of the sheet in its width direction and second perforation portions 15*b* that form two holds in opposite end parts of the sheet in its width direction. The first and second perforation portions 15*a* and 15*b* perforate the sheet that passes between the upper and lower guides 16 and 17.

The shaft 12 is disposed so as to extend over the first and second perforation portions 15*a* and 15*b*. The shaft 12 is fitted with cams 14. The shaft 12 is coupled via a gear with the spindle of the perforation motor 11. As the perforation motor 11 rotates the shaft 12, together with the shaft 12 the cams 14 rotate. For example, rotating the perforation motor 11 one turn results in the shaft 12 rotating one turn. The shaft 12 is rotatably supported on pivot members 12*a*.

As shown in FIG. 6, the cams 14 are fitted at four places along the axial direction of the shaft 12, and includes first cams 14*a* that are provided at two places on a middle part of the shaft 12 along the axial direction and second cams 14*b* provided at two places on opposite end parts of the shaft 12 along the axial direction. The first cams 14*a* are disposed to correspond to, out of the four perforation portions 15, the inner two, first, perforation portions 15*a*, and the second cams 14*b* are disposed to correspond to the outer two, second, perforation portions 15*b*.

The first and second perforation portions 15*a* and 15*b* each have a perforation blade 9, a contact member 18, and a coil spring (urging member) 19. The perforation blade 9 is, for example, a metal pipe, with a blade formed at its bottom end. Over the perforation blade 9, the contact member 18 is provided, with the top end of the perforation blade 9 in contact with the bottom face of the contact member 18. The upper and lower guides 16 and 17 have holes (not illustrated) formed at positions opposite the perforation blades 9. As the perforation blade 9 moves down, its bottom end strikes the sheet, and as the perforation blade 9 moves further down, it penetrates and thereby perforates the sheet, After perforation, the perforation blade 9 retracts upward so as not to hamper perforation on the subsequently conveyed sheet. In the following description, a distinction is made between the perforation blades 9 in the first perforation portions 15*a*, which are referred to as first perforation blades 9*a*, and the perforation blades 9 in the second perforation portions 15*b*, which are referred to as second perforation blades 9*b*.

Under the shaft 12 and the first and second cams 14*a* and 14*b*, the contact members 18 are provided. As shown in FIG. 6, the first and second cams 14*a* and 14*b* have an elliptical shape as seen along the axial direction of the shaft 12, and the circumferential faces of the first and second cams 14*a* and 14*b* lie in contact with the top faces of the contact members 18. The contact members 18 are urged upward by the coil springs 19. As the shaft 12 under the driving force of the perforation motor 11 rotates, the radii of the first and second cams 14*a* and 14*b* at their contact with the contact members 18 change with the rotation angle of the shaft 12. That is, with the rotation angle of the shall 12, the strokes by which the first and second cams 14*a* and 14*b* press the contact members 18 change.

Figure 7:
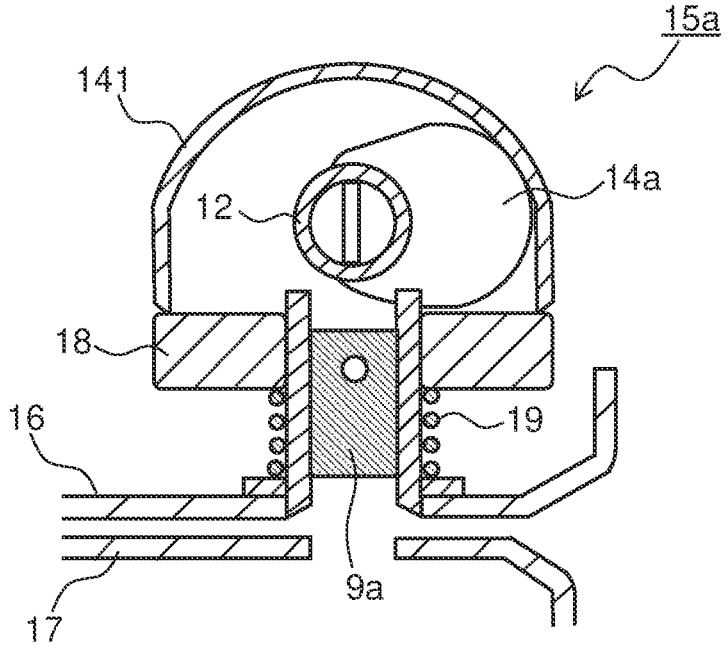
FIG. 7 is a sectional side view showing operation of the first perforation portion in the perforation device according to the embodiment, with a first perforation blade retracted up.
Figure 8:
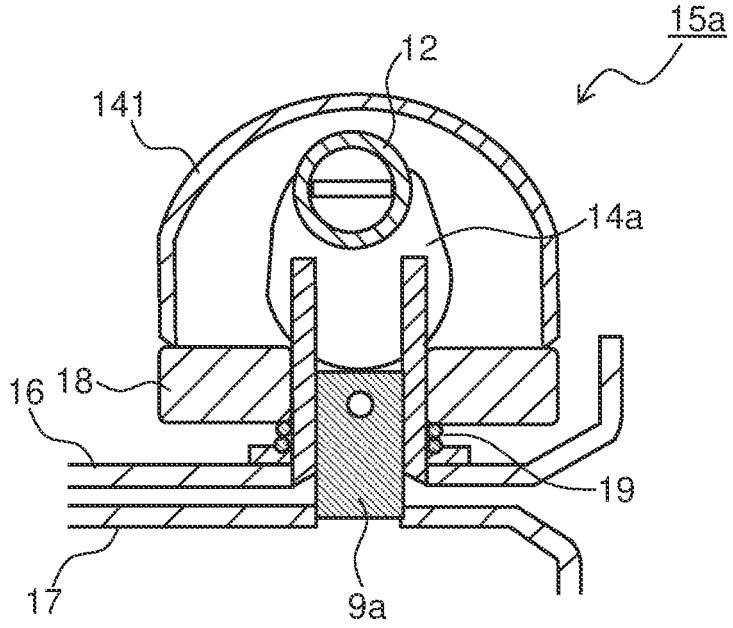
FIG. 8 is a sectional side view showing operation of the first perforation portion in the perforation device according to the embodiment, with the first perforation blade protruding down.

FIGS. 7 and 8 are sectional side views showing the operation of the first perforation portion 15*a* in the perforation device 1 according to the embodiment. As shown in FIG. 7, with the small-radius part of the first cam 14*a* in contact with the contact member 18, the urging force of the coil spring 19 keeps the contact member 18 up, so that the first perforation blade 9*a* remains retracted up. In contrast, as shown in FIG. 8, with the large-radius part of the first cam 14*a* in contact with the contact member 18, against the urging force of the coil spring 19, the contact member 18 is kept down, so that the first perforation blade 9*a* protrudes down. Thus, as the first cam 14*a* rotates, the first perforation blade 9*a* reciprocates. While the description here deals how the first perforation portion 15*a* operates, the second cam 14*b* and the second perforation blade 9*b* in the second perforation portion 15*b* operate quite in the same manner.

Next, a description will be given of how, on the perforation device 1 according to the embodiment, switching is achieved between forming two holes in a middle part of the sheet in its width direction (hereinafter referred to as two-hole perforation) and forming a total of four holes, two in a middle part and two in opposite end parts of the sheet in its width direction (hereinafter referred to as four-hole perforation). As shown in FIG. 6, the first and second cams 14*a* and 14*b* are disposed at positions apart from each other in the axial direction, and are disposed such that they protrude from the circumferential face of the shaft 12 in directions opposite from each other (from positions 180° apart from each other). More specifically, the second cams 14*b* are disposed with a delay in phase of 180° from the first cams 14*a* with respect to the forward rotation direction (first rotation direction) of the shaft 12.

In two-hole perforation (first perforation processing), the shaft 12 is rotated forward through 90° (one fourth of a turn) to bring the large-radius part of the first cam 14*a* into contact with the contact member 18 in the first perforation portion 15*a* so that, together with the contact member 18 the first perforation blade 9*a* is pushed down. Then the shaft 12 is rotated further forward through 90° (a half turn) to bring the small-radius part of the first cam 14*a* into contact with the contact member 18 in the first perforation portion 15*a* so that, together with the contact member 18 the first perforation blade 9*a* is raised. Then the shaft 12 is rotated backward (in the second rotation direction) through 90° to bring the large-radius part of the first cam 14*a* once again into contact with the contact member 18 in the first perforation portion 15*a* so that, together with the contact member 18 the first perforation blade 9*a* is pushed down. Then the shaft 12 is rotated further backward through 90° to bring the small-radius part of the first cam 14*a* into contact with the contact member 18 in the first perforation portion 15*a* so that, together with the contact member 18 the first perforation blade 9*a* is raised. Through repetition of the operation thus far, two-hole perforation is achieved with the two first perforation portions 15*a*. Here, as the shaft 12 rotates, also the second cams 14*b* rotate. Even then, since the shaft 12 rotates through less than 180°, raising the first perforation blade 9*a* in the first perforation portion 15*a* does not cause the second perforation blade 9*b* in the second perforation portion 15*b* to lower to a position where it can perforate the sheet.

In four-hole perforation (second perforation processing), the shaft 12 is rotated forward through 90° (one fourth of a turn) to bring the large-radius part of the first cam 14*a* into contact with the contact member 18 in the first perforation portion 15*a* so that, together with the contact member 18 the first perforation blade 9*a* is pushed down. Thus the two first perforation portions 15*a* form two inner holes.

Then the shaft 12 is rotated further forward through 180° (three fourths of a turn) to bring the large-radius part of the second cam 14*b* into contact with the contact member 18 in the second perforation portion 15*b* so that, together with the contact member 18 the second perforation blade 9*b* is pushed down. Thus the two second perforation portions 15*b* form two outer holes. Through repetition of the operation thus far, four-hole perforation is achieved with the two first perforation portions 15*a* and the two second perforation portions 15*b*. In this way, the first perforation portions 15*a* are involved in perforating operation (first perforation) in both two- and four-hole perforation, and the second perforation portions 15*b* are involved only in perforating operation (second perforation) in four-hole perforation.

Figure 9:
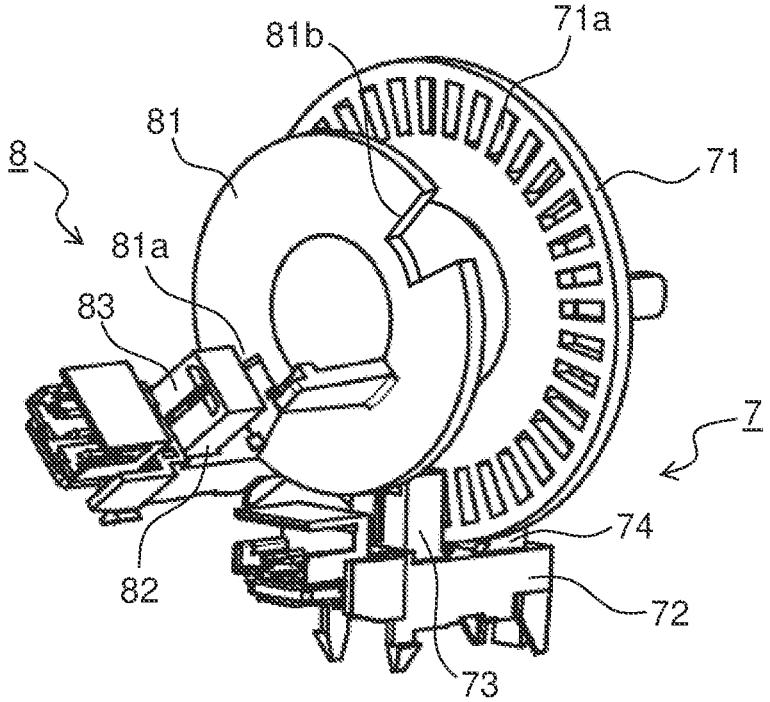
FIG. 9 is an enlarged view of a rotation speed detecting portion and a home position detecting portion used in the perforation device according to the embodiment.

FIG. 9 is an enlarged view of the rotation speed detecting portion 7 and the home position detecting portion 8 used in the perforation device 1 according to the embodiment. The rotation speed detecting portion 7 senses the rotation speed of the shaft 12 (perforation motor 11). The rotation speed detecting portion 7 includes a first pulse plate 71 and a first sensor portion 72. The first sensor portion 72 is a transmissive optical sensor. The first sensor portion 72 includes a light-emitting portion 73 and a light-receiving portion 74. The first pulse plate 71 is fitted to the shaft 12. The light-emitting portion 73 and the light-receiving portion 74 are disposed opposite each other across a circumferential edge of the first pulse plate 71 fitted to the shaft 12.

The first pulse plate 71 has a plurality of slits 71*a* formed in it. For example, the number of slits 71*a* is from several tens to several hundred (for example, 40 to 50). The slits 71*a* are disposed in the circumferential edge of the first pulse plate 71 across which the light-emitting portion 73 and the light-receiving portion 74 are disposed. The slits 71*a* are formed at intervals of a predetermined angle so that, every time the shaft 12 rotates through the predetermined angle, the output of the first sensor portion 72 (light-receiving portion 74) changes. The output that the light-receiving portion 74 yields as the first pulse plate 71 rotates between the light-emitting portion 73 and the light-receiving portion 74 is the output of the rotation speed detecting portion 7. The output of the light-receiving portion 74 is a pulse signal that rises or falls every time the shaft 12 (perforation motor 11) rotates through the predetermined angle. The output of the light-receiving portion 74 is fed to the post-processing controller 20. Based on the output of the first sensor portion 72, the post-processing controller 20 senses the shaft 12 having rotated through the predetermined angle.

Based on the period of the pulses in the pulse signal, the post-processing controller 20 senses the rotation speed of the shaft 12 (perforation motor 11). Specifically, based on the time intervals between the rising or falling edges in the pulse signal, the post-processing controller 20 senses the rotation speed of the shaft 12. To that end, the timer circuit 2*c* in the post-processing controller 20 measures the period of the pulse signal (the intervals between edges).

The rotation speed of the shaft 12 per second (in rps, i.e., revolutions per second) can be calculated in the following manner. The post-processing controller 20 divides one second by the period of a single pulse. This gives the number of pulses A per second for the current period. Then the post-processing controller 20 divides the number of pulses A by the number of pulses B that occur as the shaft 12 rotates one turn (that is, the number of slits in the first pulse plate 71). This gives the rotation speed of the shaft 12. Multiplying the result by 60 gives the rotation speed in rpm, i.e., revolutions per minute. For example, if the period of a single pulse is 10 milliseconds, then the number of pulses A equals 100; if the number of pulses B is 50, the rotation speed per second equals 100/50=2 rps.

The home position detecting portion 8 senses the shaft 12 (perforation motor 11) being at a previously determined reference angle, thereby to check whether the perforation blade 9 is at the home position. The home position detecting portion 8 includes a second pulse plate 81 and a second sensor portion 82. The second sensor portion 82 is a transmissive optical sensor. The second sensor portion 82 includes a light-emitting portion 83 and a light-receiving portion 84 (see FIG. 3). The light-emitting portion 83 and the light-receiving portion 84 are disposed opposite each other across a circumferential edge of the second pulse plate 81 fitted to the shaft 12.

The second pulse plate 81 has cuts 81*a* and 81*b* formed in its circumferential edge. The cuts 81*a* and 81*b* are formed at such position that, when the shaft 12 is at the reference angle, the output of the second sensor portion 82 (light-receiving portion 84) changes. The output that the light-receiving portion 84 yields as the second pulse plate 81 rotates between the light-emitting portion 83 and the light-receiving portion 84 is the output of the home position detecting portion 8. The output of the light-receiving portion 84 is, as a sensing signal, transmitted to the post-processing controller 20. Based on the output of the home position detecting portion 8, the post-processing controller 20 senses the shaft 12 being at the reference angle.

In the embodiment, a half turn (180° rotation) of the shaft 12 in two-hole perforation and one turn of the shaft 12 in four-hole perforation need to be sensed; accordingly, the cuts 81*a* and 81*b* are provided at positions in point symmetry with respect to the center of rotation of the second pulse plate 81. Instead, a half turn and one turn of the shaft 12 can be sensed separately with two pulse plates and two optical sensors respectively.

Here, the home position (HP) is where the perforation blades 9 (first and second perforation blades 9*a* and 9*b*) do not make contact with the sheet being conveyed. In other words, when the perforation blades 9 are at the home position, the first perforation blades 9*a* in the first perforation portions 15*a*, and the second perforation blades 9*b* in the second perforation portions 15*b* are all retracted (located away) from the sheet.

Specifically, the home position is a spatial range in which the perforation blades 9 can be located when, after the first or second cams 14*a* or 14*b* are sensed to be at the reference angle by the home position detecting portion 8, the shaft 12 is rotated forward by a previously determined number of pulses (positioning pulse count) in the output of the rotation speed detecting portion 7. For example, if the positioning pulse count is two, the reference angle is the angle of the first or second cams 14*a* or 14*b* at which they are when rotated, from the angle at which the perforation blades 9 are at the home position, forward by two pulses output from the rotation speed detecting portion 7. Accordingly, one pulse, or three pulses, from the reference angle falls outside the home position. If the number of slits 71*a* in the first pulse plate 71 is 36, the rotation angle per pulse equals 360/36=10°.

When the main power starts to be supplied to the image forming apparatus 100 and the sheet post-processing device 2, the post-processing controller 20 performs start-up operation. The start-up operation includes the positioning of the perforation blades 9 at the home position. In the operation the post-processing controller 20 rotates the perforation motor 11 forward at a low speed and when, after the shaft 12 is sensed to be at the reference angle by the home position detecting portion 8, the output of the rotation speed detecting portion 7 changes by the positioning pulse count, stops the perforation motor 11.

In two-hole perforation, the post-processing controller 20 starts to rotate the shaft 12 forward from a state where the perforation blades 9 are at the home position (the position where they are when rotated by the positioning pulse count after the sensing of the cut 81*a*). As the shaft 12 rotates forward, the first and second cams 14*a* and 14*b* rotate. As the first cams 14*a* rotate, they press down the contact members 18 in the first perforation portions 15*a*. Thus the first perforation blades 9*a* in the first perforation portions 15*a* move down. As the shaft 12 (perforation motor 11) rotates further (90° from the home position), the first perforation blades 9*a* lower down to the position at which they penetrate the sheet (to below the lower guide 17), forming holes in the sheet.

After that, as the post-processing controller 20 rotates the shaft 12 further forward, the stroke by which the first cams 14*a* push down the contact members 18 reduces. Thus, under the urging force of the coil springs 19, the first perforation blades 9*a* move up. As the shaft 12 continue rotating forward, the first perforation blade 9*a* are raised up to a position where they do not hamper sheet conveyance (to above the upper guide 16). The post-processing controller 20 stops the perforation motor 11 so that the first perforation blades 9*a* are located at the position where they are rotated through 180° from the home position (the position where they are when rotated by the positioning pulse count after the sensing of the cut 81*b*). For the next sheet, the shaft 12 is rotated backward through 180° and thereby two-hole perforation is performed again. Operating the first perforation portions 15*a* repeatedly in this way achieves continuous two-hole perforation. That is, in two-hole perforation, there are two angles of the first cams 14*a* (shaft 12) at Which the first perforation blades 9*a* are at the home position: the angles 90° rotated forward and backward, respectively, from the position at which the first perforation blades 9*a* are pushed down (see FIG. 8).

In four-hole perforation, the post-processing controller 20 starts to rotate the shaft 12 forward from a state where the perforation blades 9 are at the home position (the position where they are when rotated by the positioning pulse count after the sensing of the cut 81*a*). As the shaft 12 rotates forward, the first and second cams 14*a* and 14*b* rotate. As the first cams 14*a* rotate, they press down the contact members 18 in the first perforation portions 15*a*. Thus the first perforation blades 9*a* in the first perforation portions 15*a* move down. As the shaft 12 (perforation motor 11) rotates further (90° from the home position), the first perforation blades 9*a* lower down to the position at which they penetrate the sheet (to below the lower guide 17), forming holes in the sheet.

After that, as the post-processing controller 20 rotates the shaft 12 further forward (180° from the home position), the stroke by which the first cams 14*a* push down the contact members 18 reduces. Thus, under the urging force of the coil springs 19, the first perforation blade 9*a* move up. On the other hand, the second cams 14*b* push down the contact members 18 in the second perforation portions 15*b*. Thus the second perforation blades 9*b* in the second perforation portions 15*b* move down. As the shaft 12 (perforation motor 11) is rotated further forward (270° from the home position), the second perforation blades 9*b* lower down to the position at which they penetrate the sheet (to below the lower guide 17), forming holes in the sheet.

As the shaft 12 continue rotating forward, the second perforation blades 9*b* in the second perforation portions 15*b* are raised up to a position where they do not hamper sheet conveyance (to above the upper guide 16). The post-processing controller 20 stops the perforation motor 11 so that the first and second perforation blades 9*a* and 9*b* are located at the home position (the position Where they are when rotated by the positioning pulse count after the sensing of the cut 81*b*). That is, in four-hole perforation, there is one angle (the position in FIG. 7) of the first and second cams 14*a* and 14*b* (shaft 12) at which the first and second perforation blades 9*a* and 9*b* are at the home position: the angle 90° rotated backward from the position at which the first perforation blades 9*a* are pushed down (see FIG. 8).

Figure 10:
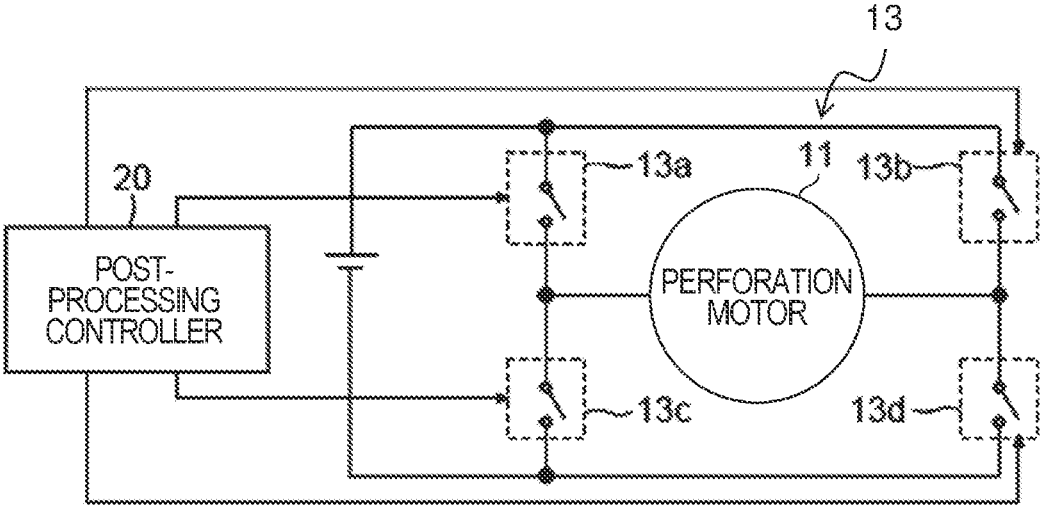
FIG. 10 is a diagram showing one example of a motor driving portion for braking control for a perforation motor in the perforation device according to the embodiment.

Braking Control for the Perforation Motor 11: Next, a description will be given of the braking control for the perforation motor 11 in the perforation device 1 according to the embodiment. FIG. 10 is a diagram showing one example of the motor driving portion 13 that controls the braking of the perforation motor 11 in the perforation device 1 according to the embodiment.

The motor driving portion 13 turns on and off the supply of electric current to the perforation motor 11. As described above, in the perforation device 1 according to the embodiment, the perforation motor 11 is occasionally rotated backward. To achieve that the motor driving portion 13 includes four switching devices 13*a* to 13*d*. The switching devices 13*a* to 13*d* are, for example, transistors. The four switching devices constitute an H bridge circuit. The motor driving portion 13 includes an H bridge circuit. The post-processing controller 20 turns on and off the switching devices 13*a* to 13*d* individually.

To rotate the perforation motor 11 forward, the post-processing controller 20 turns the switching devices 13*a* and 13*d* on and the switching devices 13*b* and 13*c* off. To rotate the perforation motor 11 backward, the post-processing controller 20 turns the switching devices 13*a* and 13*d* off and the switching devices 13*b* and 13*c* on.

To brake the perforation motor 11, the post-processing controller 20 turns the switching devices 13*a* and 13*b* off and the switching devices 13*c* and 13*d* on. This leaves the perforation motor 11 short-circuited between the terminals, and a current tends to pass in the opposite direction compared to during rotation. Thus the perforation motor 11 is braked. That is, the post-processing controller 20 reduces the rotation speed of the perforation motor 11 by short-circuit braking.

As described previously, in the perforation device 1 according to the embodiment, the rotation angle of the shaft 12 is switched between a half turn and one turn to drive the first and second perforation portions 15*a* and 15*b* with different timing by the first cams 14*a* and the second cams 14*b*, thereby to switch between two- and four-hole perforation. Here, the duration of energizing the perforation motor 11 is longer in four-hole perforation than in two-hole perforation, and the rotation speed of the perforation motor 11 is higher in four-hole perforation than in two-hole perforation. Moreover, in four-hole perforation, the rotation angle through which the shaft 12 rotates after the end of perforation until the perforation blades 9 return to the home position is smaller.

Thus, if the timing of braking the perforation motor 11 is determined based on the timing of the latter two-hole perforation by the second perforating portions 15*b*, then inconveniently the perforation motor 11 cannot be stopped in time and the perforation blades 9 moves past the home position.

To avoid that, in the embodiment, the rotation speed of the shaft 12 during the two-hole perforation by the first perforation portions 15*a* is calculated. Based on the rotation speed of the shaft 1 during two-hole perforation, the timing of braking the perforation motor 11 in both two- and four-hole perforation is determined.

Figure 11:
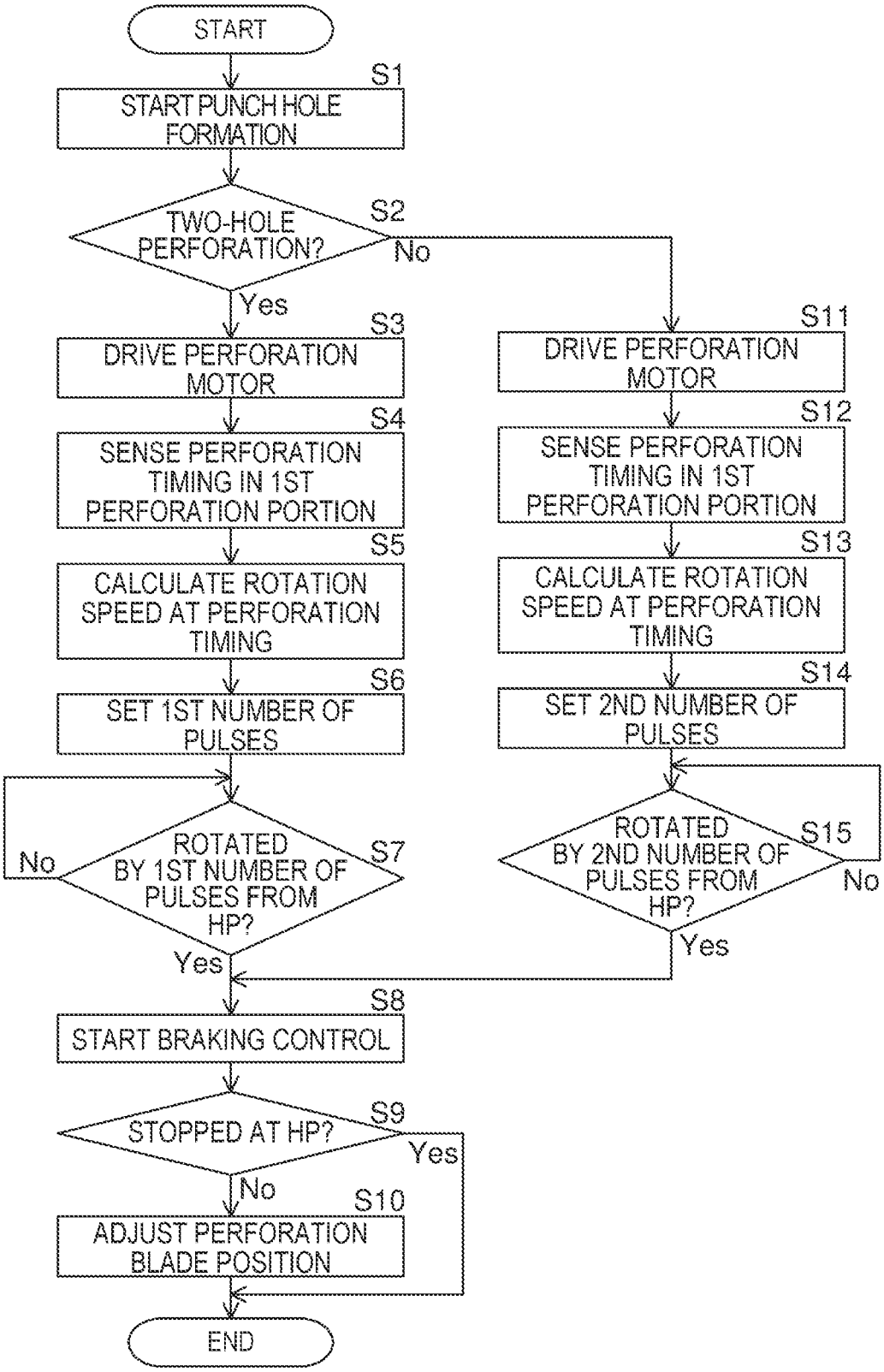
FIG. 11 is a flow chart showing an example of perforation control on the perforation device according to the embodiment.
Figure 12:
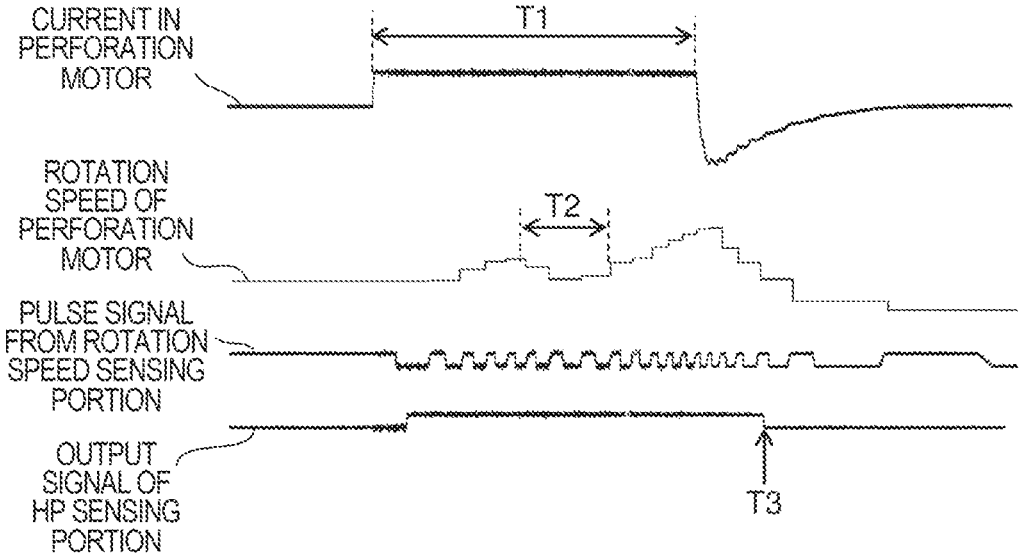
FIG. 12 is a timing chart obtained in two-hole perforation on the perforation device according to the embodiment.
Figure 13:
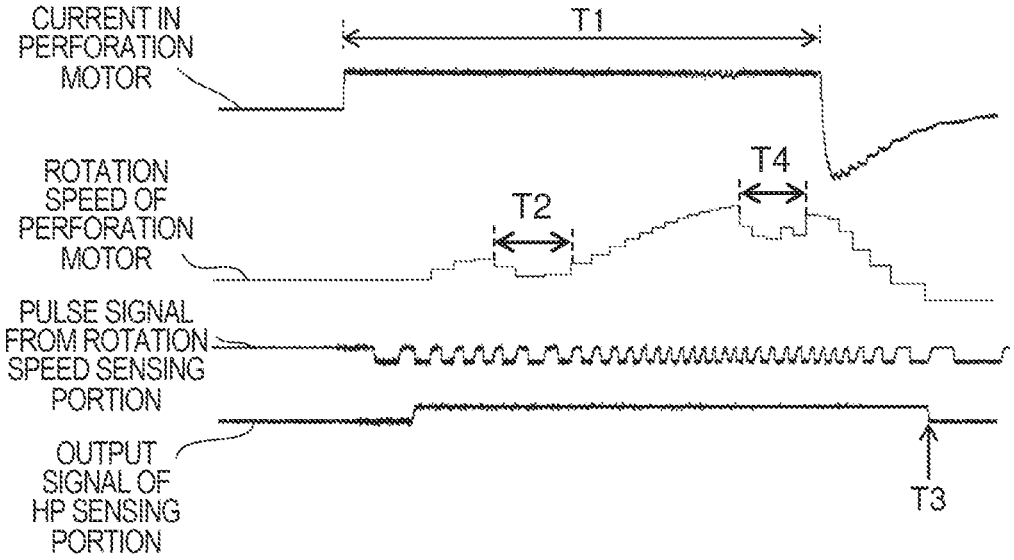
FIG. 13 is a timing chart obtained in four-hole perforation on the perforation device according to the embodiment.

Braking Control in Two- and Four-Hole Perforation: FIG. 11 is a flow chart showing one example of braking control in the perforation device 1 according to the embodiment. FIGS. 12 and 13 are examples of timing charts obtained on the perforation device 1 according to the embodiment. Now, with reference to FIGS. 12 and 13 and along the steps in FIG. 11, the braking control in two- and four-hole perforation in the perforation device 1 according to the embodiment will be described.

Assume that, at the start of perforation by the perforation device 1, the perforation blades 9 are at rest at the home position (the position where they are when rotated by the positioning pulse count after the sensing of the cut 81*a*). When in this state punch hole formation is started (step S1), the post-processing controller 20 checks whether the desired perforation pattern is two-hole perforation (step S2). If two-hole perforation is desired (Step S2, "Yes"), the post-processing controller 20 drives the perforation motor 11 (step S3).

Thus the shaft 12 and the first and second cams 14*a* and 14*b* rotate forward through 90°, and the first cams 14*a* push down the contact members 18 in the first perforation portions 15*a*. As a result, the first perforation blades 9*a* in the first perforation portions 15*a* lower down to the position at which they penetrate the sheet (to below the lower guide 17), forming two holes in the sheet. When the first perforation blades 9*a* lower down to below the lower guide 17, the perforation motor 11 is rotated further forward through 90° to rotate the shaft 12 and the first and second cams 14*a* and 14*b* forward so that the first perforation blades 9*a* in the first perforation portions 15*a* are raised.

Next, the post-processing controller 20 senses the timing of perforation by the first perforation portions 15*a* (the timing with which the first perforation blades 9*a* reach the low point) (step S4), and calculates the rotation speed of the shaft 12 at the timing of perforation (step S5). The timing of perforation by the first perforation portions 15*a* is sensed based on the number of pulses from the start of the driving of the perforation motor 11 as sensed by the rotation speed detecting portion 7 when the shaft 12 has rotated through a predetermined angle from a reference position. For example, if the number of pulses that occur in one turn of the shaft 12 from the reference position is 36, then the timing of the first-time perforation by the first perforation portions 15*a* (the timing with which the first perforation blades 9*a* reach the low point) is at the ninth pulse occurring at one fourth of a turn of the shaft 12. The rotation speed of the shaft 12 is calculated from the time interval between the pulse (ninth pulse) occurring when the first perforation blades 9*a* reach the low point and the next pulse (tenth pulse). Based on the calculated rotation speed of the shaft 12, the post-processing controller 20 determines the timing (a first number of pulses P1) with which to start braking control (step S6).

Next, the post-processing controller 20 checks whether the shaft 12 has rotated by the first number of pulses P1 from the home position (step S7). If the shaft 12 has not rotated by the first number of pulses P1 (step S7, "No"), the perforation motor 11 continue being rotated forward. If the shaft 12 has rotated by the first number of pulses P1 (step S7, "Yes"), the 20 transmits a control signal to the motor driving portion 13 to start braking control (step S8).

FIG. 12 is a timing chart obtained during two-hole perforation on the perforation device 1 according to the embodiment. FIG. 12 shows, in the top tier, one example of the current through the perforation motor 11. Shown in the second tier is the variation of the rotation speed of the perforation motor 11. The rotation speed is calculated based on the period of the pulses from the rotation speed detecting portion 7. Shown in the third tier is one example of the pulse signal from the rotation speed detecting portion 7. Shown in the bottom tier is one example of the output of the home position detecting portion 8. FIG. 12 shows an example where, when the shaft 12 is sensed to be at the home position, the output of the home position detecting portion 8 falls.

In two-hole perforation, if one turn of the shaft 12 corresponds to 36 pulses, the first perforation blades 9*a* in the first perforation portions 15*a* reach the low point when they have rotated by nine pulses (90° from the home position. At this position, the first perforation is complete, with no perforation load any longer. Thus, in two-hole perforation, the timing of starting braking control needs to be determined by predicting the stop position of the first perforation blades 9*a* based on the rotation speed at or after the tenth pulse. Here, in two-hole perforation, since the energizing duration T1 for the perforation motor 11 (the time it requires to rotate through 180°) is comparatively short, the rotation speed of the perforation motor 11 does not become high enough and remains low. Accordingly, even if the timing of starting braking control is determined based on the rotation speed of the shaft 12 during the perforation period T2, the perforation motor 11 can be stopped in time and the perforation blades 9 do not move past the home position.

After that, the post-processing controller 20 checks whether the perforation blades 9 are at rest at the home position (step S9). Specifically, based on the output signals of the home position detecting portion 8 and the rotation speed detecting portion 7, the post-processing controller 20 checks whether the first perforation blade 9*a* are at rest within the range of angles in which the first perforation blade 9*a* are at the home position. In FIG. 12, the time point at which the output of the home position detecting portion 8 falls is indicated as T3. After T3, the pulse signal from the home position detecting portion 8 changes (rises) twice. In this case, the post-processing controller 20 judges that the first perforation blades 9*a* are at rest at the home position.

If the perforation blades 9 are not at rest at the home position (step S9, "No"), the post-processing controller 20 adjusts the position of the first perforation blades 9*a* (step S10). The post-processing controller 20 rotates the perforation motor 11 forward or backward through a predetermined angle at a low speed to move the first perforation blades 9*a* to the home position.

Specifically, if the perforation motor 11 stops through braking control before the first perforation blades 9*a* reach the home position, the post-processing controller 20 rotates the perforation motor 11 forward. Then, after the home position detecting portion 8 senses the shaft 12 reaching the reference angle, the post-processing controller 20 stops the perforation motor 11 when the output of the rotation speed detecting portion 7 has changed by the positioning pulse count. By contrast, if the perforation motor 11 stops through braking control after the first perforation blades 9*a* have reached the home position, the post-processing controller 20 rotates the perforation motor 11 backward. The post-processing controller 20 rotates the perforation motor 11 backward by the number of excess pulses by which, after the home position detecting portion 8 senses the shaft 12 reaching the reference angle, the output of the rotation speed detecting portion 7 has changed beyond the positioning pulse count.

If the perforation blades 9 are at rest at the home position (step S8, "Yes"), perforation is ended.

On the other hand, if at step S2 two-hole perforation is not desired (step S2, "No"), that is, if four-hole perforation is desired, the post-processing controller 20 drives the perforation motor 11 (step S11). Thus the shaft 12 and the first and second cams 14*a* and 14*b* rotate forward, and the first cams 14*a* push down the contact members 18 in the first perforation portions 15*a*. As a result, the first perforation blades 9*a* in the first perforation portions 15*a* lower down to the position at which they penetrate the sheet (to below the lower guide 17); so the first perforating portions 15*a* perform first-time perforation, forming two holes in a middle part of the sheet in its width direction.

Next the post-processing controller 20 senses the timing of the first-time perforation by the first perforation portions 15*a* (the timing with which the first perforation blades 9*a* reach the low point) (step S12), and calculates the rotation speed of the shaft 12 at the timing of perforation (step S13). How the timing of perforation by the first perforation portions 15*a* is sensed and how the rotation speed of the shall 12 is calculated are similar to what has been described above in connection with two-hole perforation. Based on the calculated rotation speed of the shaft 12, the post-processing controller 20 determines the timing of starting braking control (a second number of pulses P2). The second number of pulses P2 is greater than the first number of pulses P1 used in two-hole perforation.

After that, as the post-processing controller 20 rotates the shaft 12 further forward, the stroke by which the first cams 14*a* push down the contact members 18 reduces. Thus, in the first perforation portions 15*a*, the first perforation blades 9*a* move up under the urging force of the coil springs 19. On the other hand, the second cams 14*b* push down the contact members 18 in the second perforation portions 15*b*. As a result, the second perforation blades 9*b* in the second perforation portion 15*b* move down. As the shaft 12 (perforation motor 11) is rotated further, the second perforation blades 9*b* lower down to the position at which they penetrate the sheet (to below the lower guide 17); so the second perforation portions 15*b* perform second-time perforation, forming two perforations in opposite end parts of the sheet in its width direction.

Next the post-processing controller 20 checks whether the shall 12 has rotated by the second number of pulses P2 from the home position (step S15), If the shaft 12 has not rotated by the second number of pulses P2 (S15, "No"), the post-processing controller 20 continues rotating the perforation motor 11 forward. If the shaft 12 has rotated by the second number of pulses P2 (S15, "Yes"), the post-processing controller 20 transmits a control signal to the motor driving portion 13 to start braking control (step S8).

FIG. 13 is a timing chart obtained during four-hole perforation on the perforation device 1 according to the embodiment. Like FIG. 12, FIG. 13 shows, in the top, second, third, and bottom tiers, the current through the perforation motor 11, the variation of the rotation speed of the perforation motor 11, one example of the pulse signal from the rotation speed detecting portion 7, and one example of the output of the home position detecting portion 8.

In four-hole perforation, the energizing duration T1 for the perforation motor 11 is comparatively long; thus, in the period (indicated as T2 in FIG. 13) of the first-time perforation by the first perforation portions 15*a*, the rotation speed of the perforation motor 11 does not become high enough and, after the first-time perforation, the rotation speed of the perforation motor 11 rises. During the period (indicated as 14 in FIG. 13) of the second-time perforation by the second perforation portions 15*b*, the rotation speed of the perforation motor 11 is high. Moreover, the time taken after the period of the second-time perforation to reach the reference position is short (the rotation angle of the shaft 12 is small).

Accordingly, in four-hole perforation, if the timing of starting braking control is determined based on the rotation speed of the perforation device 12 during the second-time perforation period T4, the perforation motor 11 cannot be stopped in time and the perforation blades 9 move past the home position.

How the timing of starting braking control is determined will now be described in more detail. In the embodiment, the rotation speed of the shaft 12 can be calculated by sensing the time interval between pulses as observed when the first perforation blades 9*a* are at the low point. Accordingly, the timing of starting braking control (in the form of a number of pulses) is previously determined in relation to the time interval between pulses (pulse interval).

For example, if the number of pulses that occur in one turn of the shaft 12 from the reference position is 36, then the timing of the first-time perforation by the first perforation portions 15*a* (the timing with which the first perforation blades 9*a* reach the low point) is at the ninth pulse occurring at one fourth of a turn of the shaft 12. Accordingly, in two-hole perforation, the time interval between the ninth and tenth pulses is calculated, and the timing of starting braking control is determined at or after the 11th pulse so that the perforation motor 11 is stopped around the 18th pulse. The time interval between the ninth and tenth pulses is calculated by invoking captures (interrupts) at the rising edges of pulses for the perforation motor 11 as sensed by the rotation speed detecting portion 7 and measuring the time taken for the pulse count to increment by one based on the ninth and tenth captured values.

On the other hand, the timing of the second-time perforation by the second perforation portion 15*b* (the timing with which the second perforation blades 9*b* are at the low point) is at the 27th pulse occurring at three fourths of a turn of the shaft 12. Here, in four-hole perforation, if, as in two-hole perforation, the time interval between the 27th and 28th pulses is calculated and the timing of starting braking control is determined at or after the 29th pulse, the perforation motor 11 cannot be stopped around the 36th pulse and the home position is overrun.

To avoid that, also in four-hole perforation, the time interval between the ninth pulse, i.e., the timing of the first-time perforation by the first perforation portions 15*a*, and tenth pulse is calculated, and the timing of starting braking control is determined at or before the 28th pulse. A relationship between the time interval (pulse interval) between the ninth and tenth pulses as calculated by experiment and the number of pulses that defines the timing of starting braking control is shown in TABLE 1.

TABLE I

| Pulse interval | Braking Start Timing | |
|---|---|---|
| | 2-Hole Perforation | 4-Hole Pertbration |
| ≤1137.5 | 11 | 25 |
| ≤1212.5 | 12 | 7.6 |
| ≤1300.0 | 13 | 26 |
| ≤1387.5 | 14 | 27 |
| 1387.5< | 15 | 27 |

As shown in TABLE 1, if the pulse interval is 1137.5 μsec or less, the timing of starting braking control is at the 11th pulse (the first number of pulses P1) in two-hole perforation and at the 25th pulse (the second number of pulses P2) in four-hole perforation. Likewise, if the pulse interval is in the range from 1137.5 to 1212.5 μsec, the timing of starting braking control is at the 12th pulse (the first number of pulses P1) in two-hole perforation and at the 26th pulse (the second number of pulses P2) in four-hole perforation. The difference in pulse interval is ascribable to the type of the sheet perforated (difference in thickness).

Thus the perforation blades 9 can be stopped fairly exactly at the home position. In this case, braking control starts somewhat earlier, and thus the rotation speed of the perforation motor 11 during the period T4 of the second-time perforation is somewhat lower. Even so, since the first-time perforation by the first perforation portions 15*a* and the second-time perforation by the second perforation portion 15*b* each involve forming two holes and hence an equal load of perforation. Thus, even though the rotation speed of the perforation motor 11 is lower, it is still higher than in the first-time perforation, and this does not affect the second-time perforation.

After that, the post-processing controller 20 checks whether the perforation blades 9 are at rest at the home position (step S9). Specifically, based on the output signals of the home position detecting portion 8 and the rotation speed detecting portion 7, the post-processing controller 20 checks whether the shaft 12 is at rest in the range of angles in which the second perforation blades 9*b* are at the home position. In FIG. 13, the time point at which the output of the home position detecting portion 8 falls is indicated as T3, After T3, the pulse signal from the rotation speed detecting portion 7 changes (rises) twice. In this case, the post-processing controller 20 judges that the perforation blades 9 are at rest at the home position.

If the perforation blades 9 are not at rest at the home position (step S9, "No"), the post-processing controller 20 adjusts the position of the perforation blades 9 (step S10). As in two-hole perforation, the post-processing controller 20 rotates the perforation motor 11 forward or backward at a low speed to move the perforation blades 9 to the home position.

In a perforation device 1 according to the embodiment, first cams 14*a* disposed for first perforation portions 15*a* which are the inner two of four perforation portions 15, and second cams 14*b* disposed for second perforation portions 15*b*, which are the outer two of the four perforation portions 15, are disposed at positions 180° apart from each other on a shaft 12. By rotating the shaft 12 a half turn, two-hole perforation is performed with the first perforation portions 15*a*; by rotating the shaft 12 one turn, four-hole perforation is performed with the first and second perforation portions 15*a* and 15*b* (continuous perforation). In four-hole perforation, the timing of starting braking control is determined based on the rotation speed of the shaft 12 at the timing of the first-time (former) two-hole perforation.

This leaves ample time (an ample rotation angle) after the start of braking control before the arrival of perforation blades 9 at the home position. It is thus possible to reduce the incidence of the inconvenience of a perforation motor 11 not stopping in time and the perforation blades 9 moving past the home position.

Thus the shaft 12 (cams 14) can be stopped approximately at a predetermined angle, and the perforation blades 9 can be stopped approximately at a predetermined position (home position). It is also possible to minimize the frequency of the adjustment of the position of the perforation blades 9 after the stop of the perforation motor 11 (shaft 12). Even if the perforation blades 9 are displaced from the home position, the displacement is smaller than is conventionally usual, it is thus possible to reduce the time required for the adjustment of the position of the perforation blades 9. This helps increase the processing efficiency (productivity) of the perforation device 1.

A rotation speed detecting portion 7 includes a first pulse plate 71 and a first sensor portion 72. The first pulse plate 71 is fitted to the shaft 12, and has a plurality of slits 71*a* formed at intervals of a predetermined angle. The first sensor portion 72 reads the slits 71*a*, and outputs a pulse signal that rises or falls every time the shaft 12 rotates through the predetermined angle. Thus the rotation angle of the shaft 12 can be sensed based on the number of pulses. The rotation speed of the shaft 12 can be sensed based on the time intervals between rising or falling edges in the pulse signal.

If, when the perforation motor 11 stops, the perforation blades 9 are at a position displaced from the home position, the post-processing controller 20 rotates the perforation motor 11 forward or backward so that the perforation blades 9 will be at the home position. Thus, when the perforation blades 9 stop at a displaced position, their position can be adjusted. That is, the angle of the shaft 12 (cams 14) can be corrected so that the perforation blades 9 will be at the home position. It is thus possible to stop the perforation blades 9 always at the home position. It is possible to rotate the shaft 12 always from the same angle.

The post-processing controller 20 reduces the rotation speed of the perforation motor 11 by short-circuit braking. Thus, after the start of braking control, the perforation motor 11 can be stopped promptly. By mounting the perforation device 1 according to the embodiment in the sheet post-processing device 2, it is possible to restrain the perforation blades 9 from overrunning the home position in four-hole perforation. This leads to smaller variation of the stop position of the perforation blades 9, and helps minimize the frequency of position adjustment for the perforation blades 9, it is thus possible to provide the sheet post-processing device 2 with high processing efficiency (productivity).

The embodiment described above is in no way meant to limit the present disclosure, which can thus be implemented with many modifications made without departure from the spirit of the present disclosure. For example, while the embodiment described above deals with a configuration where two holes are formed with two first perforation portions 15*a* and two holes are formed with two second perforation portions 15*b* to achieve switching between two-hole perforation and four-hole perforation, there may be provided any numbers of first and second perforation portions 15*a* and 15*b*.

While in the above embodiment the first and second cams 14*a* and 14*b* are disposed 180° apart from each other on the shaft 12 and the shaft 12 is rotated a half turn for two-hole perforation, the angle at which the first and second cams 14*a* and 14*b* are disposed from each other is not limited to 180°: the first and second cams 14*a* and 14*b* can be disposed opposite each other across the diameter of the shall 12. In that case, the rotation angle of the shaft 12 in two-hole perforation can be set to be a predetermined angle in accordance with the angle at which the first and second perforation portions 15*a* and 15*b* are apart from each other.

The present disclosure finds applications in perforation devices and in sheet post-processing devices incorporating perforation devices. Based on the present disclosure, it is possible to provide a perforation device that permits easy switching of perforation patterns for sheets and that can reduce variation of the stop position of perforation blades, and to provide a sheet post-processing device incorporating such a perforation device.

What is claimed is:

1. A perforation device comprising:

a shaft;

a perforation motor that rotates the shaft;

an eccentric cam fitted to the shaft;

a perforation portion having a perforation blade that perforates a sheet, the perforation portion reciprocating the perforation blade in directions toward and away from the sheet as the eccentric cam rotates;

a rotation speed detecting portion that senses a rotation speed of the shaft;

a home position detecting portion that detects whether the perforation blade is at a home position away from the sheet; and a controller that controls driving of the perforation motor, wherein the perforation portion includes at least one first perforation portion that performs first perforation on the sheet with a first perforation blade and at least one second perforation portion that performs second perforation on the sheet with a second perforation blade, the first and second perforation portion being disposed at positions away from each other in an axial direction with respect to the shaft, the eccentric cam includes at least a first cam that reciprocates the first perforation blade in the first perforation portion and at least a second cam that reciprocates the second perforation blade in the second perforation portion, the first and second cams being disposed at positions facing the first perforation portion and the second perforation portions respectively, the second cam being disposed with a delay n phase of 180° from the first cam with respect to a first rotation direction of the shaft, the controller performs a first perforation processing to perform the first perforation with the first perforation portion by rotating the shaft through 180°, a second perforation processing to perform the first perforation with the first perforation portion and the second perforation with the second perforation portion in sequence, and braking control to brake the perforation motor such that the first and second perforation blades stop at the home position, the controller detects with the rotation speed detecting portion the rotation speed of the shaft after the first perforation blade penetrates the sheet during the first perforation, and based on the rotation speed detected by the rotation speed detecting portion, the controller determines timing of starting the braking control in the second perforation and performs the braking control, in a case where a stop position of the perforation blade when the perforation motor is stopped is deviated from the home position, the controller rotates the perforation motor in the first rotation direction, or in a second rotation direction opposite from the first rotation direction at a lower speed than during perforation so as to move the perforation blade to the home position, wherein the home position detecting portion detects whether a rotation angle of the first cam or the second cam is a reference angle, and the home position is a range of position in which the perforation blade is located as the shaft is rotated in the first or second rotation direction after the home position detecting portion detects the first or second cam being at the reference angle until a number of the pulse signal outputs from the rotation speed detecting portion reaches a predefined positioning pulse count, when in the braking control, the perforation motor is stopped before the perforation blade reaches the home position, the controller rotates the perforation motor in the first or second rotation direction so that, after the first or second cam reaches the reference angle, when the first or second cams rotated by the number of positioning pulses, the controller stops the perforation motor, and when in the braking control, the perforation motor is stopped after the perforation blade passes the home position, the controller rotates the perforation motor in an opposite direction by a number of excess pulses by which, after the first or second cam reached the reference angle, the output of the rotation speed detecting portion is beyond the positioning pulse count.

2. The perforation device according to claim 1, wherein in the second perforation processing, the rotation speed of the shaft in the second perforation is higher than the rotation speed of the shaft in the first perforation.

3. The perforation device according to claim 1, wherein the rotation speed detecting portion includes a first pulse plate that is fitted to the shaft and that has a plurality of slits formed at intervals of a predetermined angle in a rotation direction and a first sensor portion that reads the slits of the first pulse plate to output a pulse signal in accordance with rotation of the first pulse plate, and when a number of pulses read by the first sensor portion reaches a predetermined value from the home position, the controller starts the braking control.

4. The perforation device according to claim 3, wherein the controller changes the predetermined value in accordance with the rotation speed of the shaft after the first perforation blade penetrated the sheet in the first perforation.

5. The perforation device according to claim 3, wherein the rotation speed of the shaft is calculated from a time interval between a pulse occurring in the pulse signal when the first perforation blade reaches a low point in the first perforation and a next pulse in the pulse signal.

6. The perforation device according to claim 1, wherein the first perforation portion includes two of the first perforation portions, the second perforation portion includes two of the second perforation portions, two of the first perforation portions are provided at two places corresponding to a middle part of the sheet in a width direction thereof, two of the second perforation portions are provided at two places corresponding to opposite end parts of the sheet in the width direction thereof, as the first perforation processing, two-hole perforation is performed such that the sheet is perforated at two places in the middle part of the sheet in the width direction thereof, and as the second perforation processing, four-hole perforation is performed such that the sheet is perforated at two places in the middle part of the sheet in the width direction thereof and at two places in the opposite end parts of the sheet in the width direction thereof.

7. The perforation device according to claim 1, wherein the controller performs the braking control by short-circuit braking.

8. A sheet post-processing device comprising the perforation device according to claim 1.

* * * * *